US007595603B2

(12) United States Patent
Zeh

(10) Patent No.: US 7,595,603 B2
(45) Date of Patent: Sep. 29, 2009

(54) METHOD AND DEVICE FOR REGULATING A PUMP

(75) Inventor: Stefan Zeh, Wangen (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 64 days.

(21) Appl. No.: 11/386,261

(22) Filed: Mar. 22, 2006

(65) Prior Publication Data

US 2006/0245931 A1 Nov. 2, 2006

(30) Foreign Application Priority Data

Mar. 22, 2005 (DE) ..... 10 2005 013 773

(51) Int. Cl.
*H02P 3/18* (2006.01)

(52) U.S. Cl. ..... 318/717; 318/431; 318/400.11; 318/400.32; 318/228.1; 318/228.4

(58) Field of Classification Search ..... 318/717, 318/700, 439, 431, 499.11; 388/804; 62/175, 62/228.4

See application file for complete search history.

(56) References Cited

U.S. PATENT DOCUMENTS

| | | | | |
|---|---|---|---|---|
| 3,027,307 | A * | 3/1962 | Stoffer et al. | 378/52 |
| 5,779,450 | A * | 7/1998 | Fujiwara et al. | 417/45 |
| 5,859,520 | A | 1/1999 | Bourgeois et al. | |
| 6,014,004 | A * | 1/2000 | Hamaoka et al. | 318/778 |
| 6,462,492 | B1 * | 10/2002 | Sakamoto et al. | 318/400.32 |
| 6,642,681 | B2 * | 11/2003 | Kawabata et al. | 318/431 |
| 6,832,488 | B2 * | 12/2004 | Yokozeki et al. | 62/175 |
| 6,925,824 | B2 * | 8/2005 | Matsunaga et al. | 62/228.4 |
| 7,023,158 | B2 * | 4/2006 | Hirono | 318/400.11 |
| 7,095,204 | B2 * | 8/2006 | Lee et al. | 318/700 |
| 7,102,306 | B2 * | 9/2006 | Hamaoka et al. | 318/400.01 |
| 7,143,491 | B2 * | 12/2006 | Wood | 29/275 |
| 2002/0117989 | A1 * | 8/2002 | Kawabata et al. | 318/700 |
| 2006/0119310 | A1 * | 6/2006 | Ide et al. | 318/801 |
| 2006/0132075 | A1 * | 6/2006 | Lee et al. | 318/439 |
| 2006/0177204 | A1 * | 8/2006 | Zeh et al. | 388/804 |
| 2006/0179859 | A1 * | 8/2006 | Nakata et al. | 62/228.1 |

FOREIGN PATENT DOCUMENTS

| | | | |
|---|---|---|---|
| DE | 29 46 049 | A1 | 5/1981 |
| DE | 196 17 570 | C1 | 12/1997 |
| DE | 201 18 137 | UA | 3/2003 |
| EP | 0 801 463 | A1 | 10/1997 |
| JP | 58152187 | A * | 9/1983 |
| JP | 10047795 | A * | 2/1998 |

* cited by examiner

*Primary Examiner*—Paul Ip
(74) *Attorney, Agent, or Firm*—Laurence A. Greenberg; Werner H. Stemer; Ralph E. Locher

(57) ABSTRACT

Electronic motor regulation for a pump with a multi-phase permanent-magnet synchronous motor (PMSM). The system is enabled to detect and estimate a rotor phase position and rotary speed. Foam or air operation is detected by way of fluctuations in the estimated rotary speed.

6 Claims, 2 Drawing Sheets

METHOD AND DEVICE FOR REGULATING A PUMP

BACKGROUND OF THE INVENTION

Field of the Invention

The invention relates to electronic closed-loop motor control for a pump with a multi-phase permanent-magnet synchronous motor (PMSM). The actuation of the pump is effected by way of a so-called inverter by pulse width modulation (PWM) of a d.c. voltage from a d.c. voltage intermediate circuit. In particular on the basis of calculation values which are internal to the regulator, namely, the estimated rotary speed of the motor or the motor reference voltage, or by way of power measurement, or a combination of those values, the assembly reliably detects whether the pump is conveying liquid medium or air or foam. Motor regulation is described, and the way in which the measurement and calculation values are appropriately used and evaluated for foam or air detection.

In the case of pump systems as for example in a dishwasher, it is frequently not desirable for foam or air to be conveyed. In the case of a dishwasher for example operation with air is linked to annoying noises while operation with foam involves a great reduction in the cleaning effect. If air or foam operation is detected, the appliance control system can intervene in terms of procedural control and remove the defect. Among other solutions, it is possible to add more liquid or to alter the rotary speed of the pump in order to break down foam.

Commonly assigned German utility model DE 201 18 137 U1 (Gebrauchsmuster) proposes a d.c. motor as a pump drive for a dishwasher. Air operation is detected by a fluctuating power draw by the pump motor. Those significant power fluctuations however only occur in the situation where intermittent operation of air and water occurs. The method is therefore applied only when filling and emptying the dishwasher. Slow-onset formation of foam cannot be detected. There is also no detailed discussion of the way in which the power draw of the motor is to be ascertained.

German patent DE 196 17 570 discloses an unregulated immersion pump. The lower water level or air operation is ascertained by way of the rotary speed which occurs in dependence on load. In air operation that pump runs much higher than its nominal rotary speed. In many uses—such as for example in the case of a dishwasher—that can give rise to troublesome noise, and for that reason the rotary speed is always regulated in a dishwasher. The fatal fault situation can also occur, where the pump which is running too fast no longer conveys any liquid at all, even if its suction conduit is again completely filled with liquid. More specifically, in the case of pumps which are running too fast, spontaneous evaporation of the liquid can occur due to the reduced pressure in the flow, whereby the pump no longer delivers any hydraulic output. In addition that method is also too insensitive for foam detection.

German published, non-prosecuted patent application DE 29 46 049 discloses a rotary pump with asynchronous motor, in which the rotary speed is ascertained by way of external rotary sensors, and the power draw is also measured. The through-flow rate is ascertained on the basis of the two values involved. In that method the absolute value of the power is crucial and therefore requires an accurate and also costly power measurement device. The rotary speed sensor arrangement also gives rise to additional costs, in comparison with the invention proposed here.

U.S. Pat. No. 5,859,520 and European patent application EP 0 801 463 A1 disclose the regulation of a permanent-magnet synchronous motor without position or commutation sensors. That specification can be used as an illustration of phase detection, which will not be described in greater detail here. The two disclosures are herewith incorporated by reference. The disclosures do not deal with the application of pump or air or foam detection.

SUMMARY OF THE INVENTION

It is accordingly an object of the invention to provide a method of regulating a multiphase brushless electric motor which overcomes the disadvantages of the heretofore-known devices and methods of this general type and which, besides efficient closed-loop control of the motor, enables detection of air or foam pumping operation and in that way renders it optionally possible to save on additional sensor means.

With the foregoing and other objects in view there is provided, in accordance with the invention, a method of regulating an electronic motor for a pump with multi-phase permanent-magnet synchronous motor (PMSM), which comprises:

providing means for detecting and estimating a rotor phase position of the motor and a rotary speed of the motor; and deducing, from fluctuations in the estimated rotary speed, foam or air operation of the pump.

In other words, the invention provides for electronic motor regulation for a pump with a multi-phase permanent-magnet synchronous motor (PMSM) with means for detecting and estimating the rotor phase position and rotary speed. Here, foam or air operation is detected by way of fluctuations in the estimated rotary speed.

In accordance with an added feature of the invention, are provided additional means for measuring the power flow from the d.c. voltage source, and the measured power flow is additionally used for foam or air recognition.

With the above and other features in view there is also provided, in accordance with the invention, an electronic motor regulation for a pump with multi-phase permanent-magnet synchronous motor (PMSM) with means for detecting and estimating the rotor phase position and rotary speed. Here, the frequency of the outputted motor voltage is limited upwardly and those results of the limitation are used as an indicator for foam or air.

It will be understood by those of skill in the pertinent art that the following description on the basis of a three-phase configuration of the motor is but one exemplary implementation of the poly-phase concept. The invention is equally applicable to two-phase or other multi-phase motors.

Other features which are considered as characteristic for the invention are set forth in the appended claims.

Although the invention is illustrated and described herein as embodied in a method of regulating a pump, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
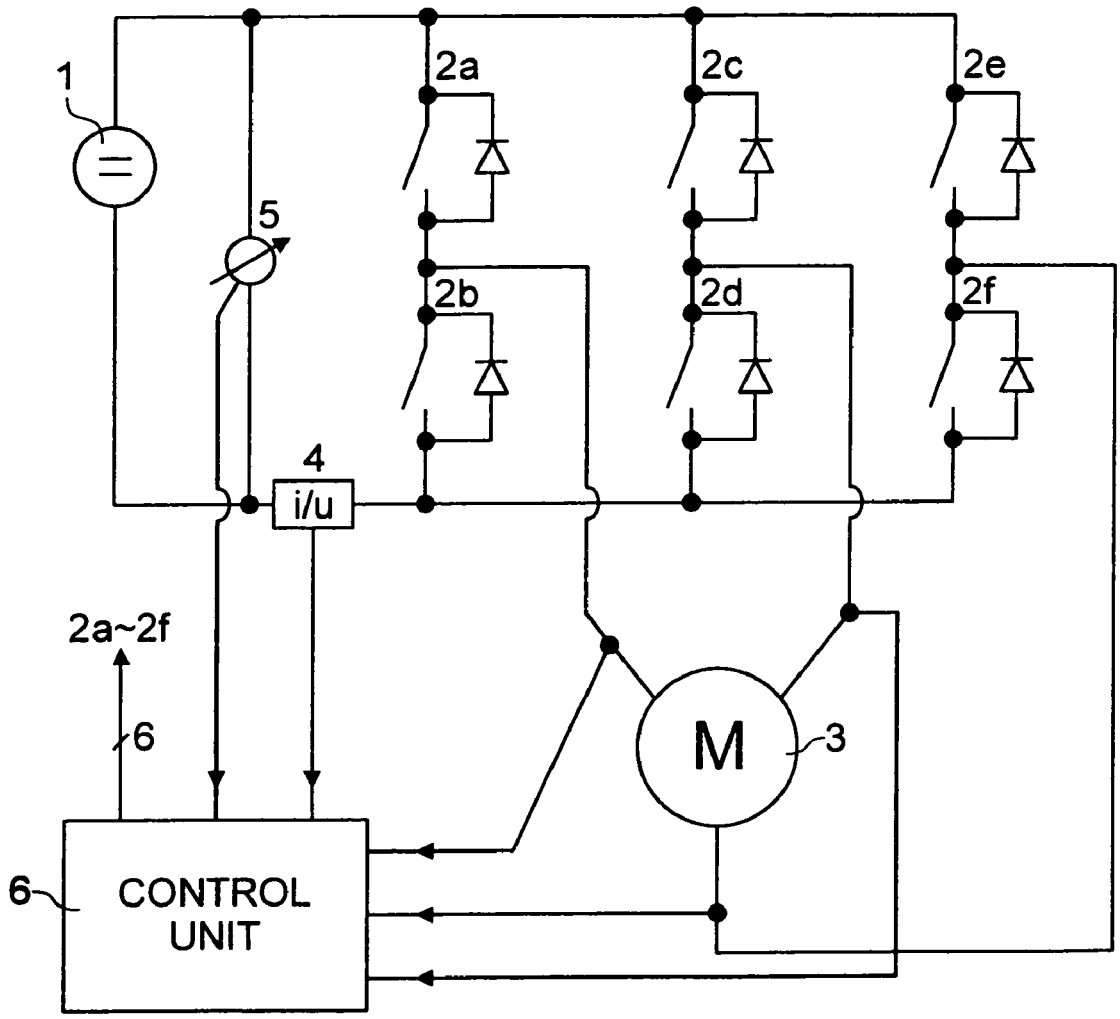
FIG. 1 is a schematic block diagram showing the main components of the electronically regulated pump system according to the invention.

Referring now to the figures of the drawing in detail and first, particularly, to FIG. 1 thereof, there is shown the electronically regulated pump system. The term "regulation" as used herein is synonymous with "closed-loop control." The phases of the multi-phase permanent-magnet motor 3 are switched by way of six power switches with parallel recovery diodes 2*a* through 2*f* intermittently to the high-voltage side and the low-voltage side respectively of a d.c. voltage source 1. A current transformer 4 measures the current which flows in total from the d.c. voltage source 1 to the switches 2*a* through 2*f*. A voltage transformer 5 measures the voltage of the source 1. A closed-loop control unit 6, or regulator 6, receives measurement signals from at least one of the phases of the motor 3, from the current transformer 4 and from the voltage transformer 5 and it actuates the six power switches 2*a* through 2*f*.

Figure 2:
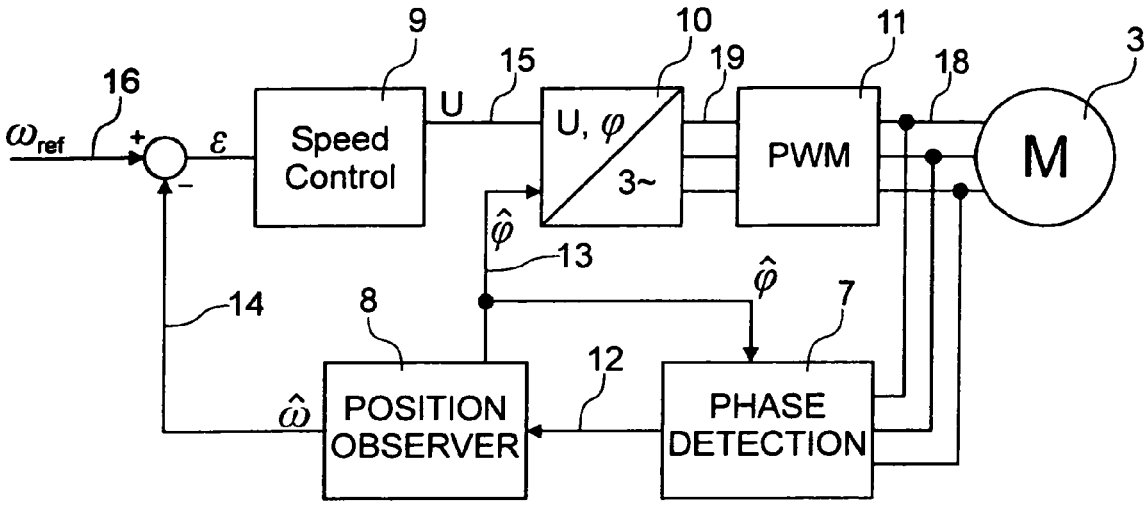
FIG. 2 is a block diagram of the system.

FIG. 2 shows a possible configuration of the closed-loop control unit 6. A position observer 8 ascertains in time-discrete mode at high frequency an estimation 13 of the current position of the motor. A phase detection 7 supplies the position observer 8 in that respect with an item of information 12 which specifies whether, and possibly how much, the rotor of the motor leads or trails the estimated position 13. The leading/trailing information 12 is at a maximum always available when a voltage induced in the three motor windings, the so-called electromotive force (emf), completes a zero-crossing. That is the case in each phase twice per period. In the case of a three-phase motor, therefore, this is a maximum of 6 times per period. Phase detection 7 can also be based on Hall sensors which detect the phase position of the rotor by way of the magnetic field thereof. In such a case, for cost reasons, frequently only one Hall sensor is used, whereby the frequency of the items of information 12 is reduced. The position observer 8 simultaneously also supplies the time derivative of the estimated position 13, that is to say an estimated motor rotary speed 14. A rotary speed regulator 9 calculates an output signal 15 on the basis of the difference between the reference or target rotary speed 16 and the estimated rotary speed 14.

The output signal 15 of the rotary speed regulator will be assumed here to be the reference or target motor voltage U. Configurations are also known however in which the rotary speed regulator 9 presets a reference motor current, which is supplied to a subordinated current regulator. In that case the subordinated current regulator then produces as the output the reference motor voltage or directly influences the PWM unit 11.

A coordinate transformer 10 converts the polar coordinates—the voltage 15 and the estimated position 13—to a three-phase voltage system, that is to say to three absolute values 19. The downstream-connected PWM unit 11 ascertains from those values 19 a pulse pattern with which the six power switches 2*a* through 2*f* are actuated. In that way a three-phase a.c. voltage system 18 is applied to the motor, that system having the reference motor voltage 15 and the estimated motor rotary speed 14. On the basis of self-regulation of the motor, the rotary speed 14 estimated by the position observer 8 is also at the same time the actual rotor speed. The motor runs synchronously with the applied a.c. voltage system.

The closed-loop control, i.e., the self-regulation of the motor however also has its limits. If the rotary speed estimation 14 and the position estimation 13 of the position observer 8 deviate too far from the actual conditions in the motor, the motor stalls and abruptly stops.

The closed-loop control unit 6 can ascertain the power fed to the motor by multiplication of the measurement signals from the current transformer 4 and the voltage transformer 5.

Figure 3:
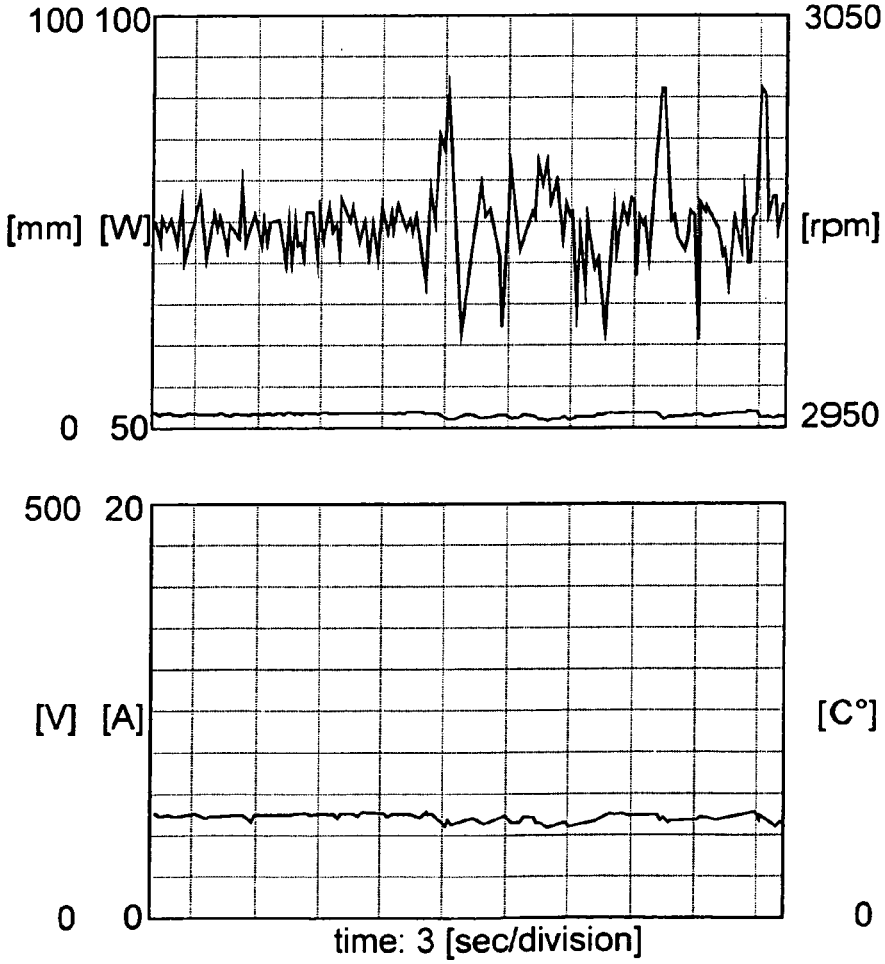
FIG. 3 shows two graphs plotting the variation in respect of time of the estimated rotary speed 14, the reference motor voltage 15, and the ascertained power.

FIG. 3 shows the variation in respect of time of the estimated rotary speed 14, the reference motor voltage 15 and the ascertained power. In the first half, the pump is conveying liquid while in the second half foam is additionally present. The fluctuations in the rotary speed 14 are most significant.

In accordance with the invention it is proposed that identification numbers for the fluctuations of a value be calculated, by a procedure wherein:

- the min/max values are ascertained cyclically over a given period such as for example 1 through 10 sec, and/or
- the sum of the deviations from the reference value or sliding average are totalled, and/or
- the sum of the squares of the deviations from the reference value or average are ascertained.

For the purposes of foam and air detection, it is proposed that one or more of the above-specified identification numbers relating to the fluctuation of the estimated rotary speed 14 be ascertained. It is then easily possible to define ranges of those numbers, which are typical in respect of foam and air.

It is proposed in accordance with the invention that the identification numbers in respect of the fluctuations and the absolute value in respect of the ascertained power 17 are additionally used for the purposes of foam and air detection.

In addition to the rotary speed 14 or in place thereof, it is also possible to make use of the regulator output value 15 in order to ascertain identification numbers in relation to the fluctuation thereof and to use same for air and foam detection. As the rotary speed regulator 9 only represents a filter in respect of its input values—that is to say the estimated rotary speed 14 and the reference rotary speed 16—the original values 14 and 16 are more meaningful for foam and air detection.

In accordance with fuzzy logic weighting factors for the various identification numbers and the votes resulting therefrom for foam and air can be defined in a matrix and then the weighted sums can be evaluated for foam detection.

A very short overshoot of the rotary speed is very typical of foam. In order to prevent an overshoot of the rotary speed it is proposed that the frequency of the applied motor voltage 18 is limited upwardly. In such a limit case the motor would work with a worse level of efficiency or would be operated as a generator. Those operating states however are not disadvantageous, for a short time. With a suitable choice of the upper rotary speed limit—depending on the rotary speed reference value—the occurrence of such a limitation can also be used as an indication in respect of foam or air.

This application claims the priority, under 35 U.S.C. § 119, of German patent application No. 10 2005 013 773.3, filed Mar. 22, 2005; the disclosure of the prior application is herewith incorporated by reference in its entirety.

I claim:

1. A method for detecting foam or air operation of a pump with multi-phase permanent-magnet synchronous motor (PMSM), which method comprises:

providing means for detecting and estimating a rotor phase position of the motor and a rotary speed of the motor; and a device for deducing in a time discrete mode, from fluctuation to the estimated rotary speed, foam or air operation of the pump.

2. The method according to claim 1, which comprises:

measuring a power flow from a d.c. voltage source supplying the motor; and additionally using the measured power flow for foam or air recognition.

3. A method for detecting foam or air operation of a pump with multi-phase permanent-magnet synchronous motor (PMSM), which method comprises:

providing means for detecting and estimating a rotor phase position of the motor and a rotary speed of the motor; and limiting a frequency of a motor voltage output to the motor upwardly, a device for deducing in a time discrete mode, from fluctuation to the estimated rotary speed, and using the results of the frequency limitation as an indicator for foam or air.

4. A closed-loop control circuit for detecting foam or air operation of a pump a multi-phase permanent-magnet synchronous motor (PMSM), comprising:

means for detecting and estimating a rotor phase position of the motor and a rotary speed of the motor; and a closed-loop control unit connected to said means and configured to deduce in a time discrete mode, from fluctuation in the estimated rotary speed, foam or air operation of the pump.

5. The control circuit according to claim 4, which further comprises means for measuring a power flow from a d.c. voltage source supplying the motor, and said closed-loop control unit is configured to additionally use the measured power flow for foam or air recognition.

6. A closed-loop control circuit for detecting foam or air operation of a pump a multi-phase permanent-magnet synchronous motor (PMSM), comprising:

means for detecting and estimating a rotor phase position of the motor and a rotary speed of the motor;

a device for deducing in a time discrete mode from fluctuation to the estimated rotary speed; and a closed-loop control unit connected to said means and configure to upwardly limit a frequency of a motor voltage output to the motor, and using the results of the frequency limitation as an indicator for foam or air.

* * * * *